United States Patent [19]

Cortorillo et al.

[11] 4,363,994

[45] Dec. 14, 1982

[54] HALOGEN LAMP WITH STRAP-TYPE BULB SUPPORT MECHANISM

[75] Inventors: Salvatore F. Cortorillo, Parsippany, N.J.; Nickolas P. Demas, Cranford, N.J.; Russell C. Schwickert, Lake Hiawatha, N.J.

[73] Assignee: Edison International, Inc., Rolling Meadows, Ill.

[21] Appl. No.: 166,165

[22] Filed: Jul. 7, 1980

[51] Int. Cl.[3] ..... H01J 5/16; H01K 1/18

[52] U.S. Cl. ..... 313/113; 313/318; 313/222

[58] Field of Search ..... 313/113, 115, 318, 222, 313/25

[56] References Cited

U.S. PATENT DOCUMENTS

| | | | |
|---|---|---|---|
| 3,441,778 | 4/1969 | Deiss | 313/318 |
| 3,510,718 | 5/1970 | Vetere | 313/318 |
| 3,617,797 | 11/1971 | Meijer et al. | 313/318 |
| 3,904,909 | 9/1975 | Vause | 313/318 |
| 4,088,918 | 5/1978 | Gates et al. | 313/315 |
| 4,138,621 | 2/1979 | Downing et al. | 313/113 |
| 4,146,814 | 3/1979 | Wojtowicz | 313/220 |
| 4,149,103 | 4/1979 | Gates et al. | 313/315 |

FOREIGN PATENT DOCUMENTS

| | | | |
|---|---|---|---|
| 1380986 | 10/1964 | France | 313/318 |

*Primary Examiner*—Robert Segal

*Attorney, Agent, or Firm*—Laparte, Gealau, MacKinnon

[57] ABSTRACT

In an electric lamp, a bulb is supported by straps which extend around and engage the bulb base. The straps are spaced apart longitudinally of the bulb.

8 Claims, 5 Drawing Figures

HALOGEN LAMP WITH STRAP-TYPE BULB SUPPORT MECHANISM

BACKGROUND AND SUMMARY OF THE INVENTION

This invention relates generally to electric lamps and more particularly to electric head lamps for motor vehicles.

In vheicle halogen head lamps, a tungsten halogen bulb is used as the primary light source. In comparison with a bare tungsten filament which has been used as the primary light source in conventional vehicle head lamps, the tungsten halogen bulb is quite massive and commonly weighs about one hundred times more than the bare filament. Therefore, it is very important that the tungsten halogen bulb be rigidly mounted in the head lamp so that the filament in the bulb remains in a predetermined location relative to the reflector after the head lamp is assembled.

The present invention provides a bulb support mechanism that securely and accurately holds a halogen bulb of either the single filament type or the dual filament type. The bulb support mechanism includes a pair of straps which extend around and engage the bulb base at locations spaced apart longitudinally of the bulb. In the preferred embodiment, the bulb base is substantially flat and includes a protuberance on each side which is located between the straps and which keeps the straps separated and electrically insulated from each other. When the present invention is used in connection with a vehicle head lamp having a bulb, a reflector, and two support wires connected to the reflector, the two straps are attached to the bulb base as previously stated and are secured to the two support wires thereby rigidly mounting the bulb in the head lamp.

DESCRIPTION OF THE PREFERRED EMBODIMENT

Figure 1:
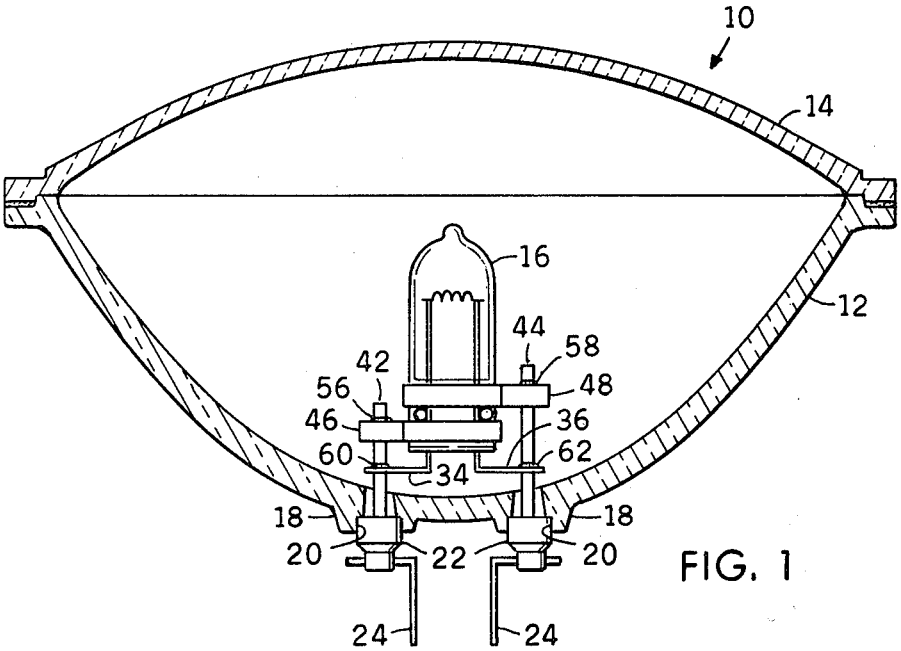
FIG. 1 is a sectional view of a vehicle head lamp embodying the present invention.

Referring to FIG. 1, a vehicle electric head lamp 10 embodying the present invention includes a reflector 12, a lens 14, and a bulb 16 such as a tungsten halogen bulb. The reflector 12 and the lens 14, preferably formed of glass or plastic, are secured together at their peripheries by conventional means such as fusion sealing, screws, or adhesive, thereby forming an enclosure.

The reflector 14 has a pair of basses 18 integrally formed on its rear surface and a pair of openings 20 extending therethrough. Ferrules 22 are secured to the bosses 18 so as to cover the openings 20. Terminals 24 are attached to the ferrules 22 for connecting the head lamp 10 to the electrical power supply of a vehicle.

Figure 2:
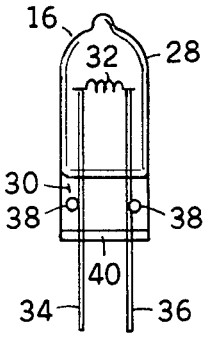
FIG. 2 is a view of the bulb used in the head lamp of FIG. 1.
Figure 3:
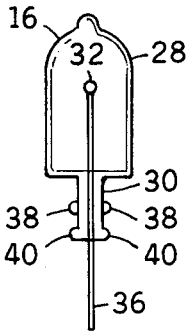
FIG. 3 is a side view of the bulb illustrated in FIG. 2.

The bulb 16, preferably formed of glass, includes a substantially cylindrical envelope 28 and a substantially flat pressed base 30. See FIGS. 2 and 3. A filament 32 is supported in the bulb envelope 28 by a pair of lead wires 34, 36 which extend through the bulb base 30. A pair of protuberances 38 and a raised edge 40 are provided on each flat side of the bulb base 30. The protuberances 38 and the raised edges 40 are preferably integrally molded into the bulb base 30.

Figure 5:
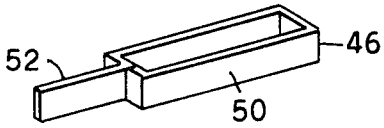
FIG. 5 is an enlarged view of part of the support mechanism shown in FIG. 4.
Figure 4:
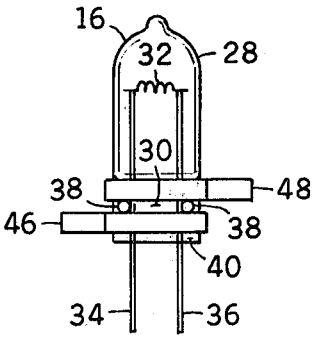
FIG. 4 is a view of the assembled bulb and support mechanism used in the head lamp of FIG. 1.

Support wires 42, 44 are secured to the ferrules 22 by conventional means such as welding or brazing and extend into the enclosure of the head lamp 10. A bulb support mechanism includes straps 46, 48 that extend around and engage the bulb base 30. As seen in FIG. 4, the protuberances 38 keep the straps 46, 48 spaced apart and electrically insulated from each other, and the raised edges 40 prevent the strap 46 from sliding off the bulb base 30. The straps 46, 48 are identical and each is preferably formed of a piece of flat metal stock shaped as shown in FIG. 5 into a loop 50 which fits tightly around the bulb base 30. Each of the straps 46, 48 also includes an arm 52 for attachment to one of the support wires 42, 44.

Referring again to FIG. 1, the straps 46 and 48 are secured to the support wires 42 and 44 at 56 and 58, respectively, by conventional means such as welding or brazing. The bulb lead wires 34 and 36 are secured to the support wires 42 and 44 at 60 and 62, respectively, by conventional means such as welding or brazing. Thus, the bulb 16 is rigidly mounted in the enclosure of the head lamp 10 and is electrically connected to the terminals 24, and the filament 32 in the bulb 16 remains in a predetermined location relative to the reflector 12 after the head lamp 10 is assembled.

In manufacturing the head lamp 10, the bulb 16 and the straps 46, 48 are assembled as a unit as shown in FIG. 4. This unit is then mounted on the reflector 12 by securing the arms 52 of the straps 46, 48 to the support wires 42, 44 near the free ends thereof. Then the ends of the bulb lead wires 34, 36 are secured to the support wires 42, 44 near the midpoints thereof.

Although the present invention has been described in connection with a single filament bulb such as bulb 16, it could also be used with dual filament bulbs which have two filaments and four lead wires. Two support wires and two straps would still be used to support a dual filament bulb in the same manner previously described. In a vehicle head lamp, two of the lead wires from the dual filament would be secured to the two support wires which are connected to two terminals on the reflector as described previously, and the other two lead wires would be connected to a third terminal mounted on the reflector.

The present invention is not limited for use in round lamps such as head lamp 10 and, accordingly, may be used in rectangular lamps.

While the present invention has been disclosed with reference to the preferred embodiment thereof, it is apparent that there may be other embodiments which are within the scope of the invention as defined by the following claims.

What is claimed is:

1. An electric lamp comprising:

(a) a reflector;

(b) a bulb having a base at one end thereof;

(c) first and second support wires connected to said reflector;

(d) first and second straps extending around and engaging said bulb base at locations spaced apart longitudinally of said bulb; and (e) said first and second straps being connected to said first and second support wires, respectively, said bulb including a filament and first and second lead wires connected thereto and said first and second lead wires being connected electrically to said first and second support wires.

2. The electric lamp defined in claim 1, wherein said first and second lead wires are connected to said first and second support wires independent of said first and second straps.

3. The electric lamp defined in claims 1 or 2 wherein said first and second straps each form a loop which extends completely around the periphery of said bulb base.

4. The electric lamp defined in claims 1 or 2 wherein said bulb base is substantially flat and includes a protuberance on each side which is located between said first and second straps and which keeps said first and second straps separated and electrically insulated from each other.

5. In a vehicle head lamp of the type including a reflector, a lens secured to said reflector to define an enclosure therebetween, a bulb disposed in said enclosure, said bulb having a base at one end thereof, and first and second support wires connected to said reflector and extending into said enclosure, the improvement comprising first and second straps extending around and engaging said bulb base at locations spaced apart longitudinally of said bulb, and said first and second straps being connected to said first and second support wires, respectively, said bulb including a filament and first and second lead wires connected thereto and said first and second lead wires being connected electrically to said first and second support wires.

6. The improvement defined in claim 5, wherein said first and second lead wires are connected to said first and second support wires independent of said first and second straps.

7. The improvement defined in claim 5, wherein said first and second straps each form a loop which extends completely around the periphery of said bulb base.

8. The improvement defined in claims 5 or 7, wherein said bulb base is substantially flat and includes a protuberance on each side which is located between said first and second straps and which keeps said first and second straps separated and electrically insulated from each other.

* * * * *